US008859175B2

(12) United States Patent
Sugawara et al.

(10) Patent No.: US 8,859,175 B2
(45) **Date of Patent: *Oct. 14, 2014**

(54) TRANSPARENT TONER FOR DEVELOPING ELECTROSTATIC LATENT IMAGE, ELECTROSTATIC LATENT IMAGE DEVELOPER, TONER CARTRIDGE, PROCESS CARTRIDGE, IMAGE FORMING APPARATUS AND IMAGE FORMING METHOD

(75) Inventors: Atsushi Sugawara, Kanagawa (JP); Masaru Takahashi, Kanagawa (JP); Yasuo Kadokura, Kanagawa (JP); Masanobu Ninomiya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 584 days.

This patent is subject to a terminal disclaimer.

(21) Appl. No.: 12/577,996

(22) Filed: Oct. 13, 2009

(65) Prior Publication Data

US 2010/0183968 A1 Jul. 22, 2010

(30) Foreign Application Priority Data

Jan. 19, 2009 (JP) ..... 2009-009185

(51) Int. Cl.
*G03G 9/08* (2006.01)
*G03G 9/09* (2006.01)
*G03G 9/087* (2006.01)

(52) U.S. Cl.
CPC ..... *G03G 9/09* (2013.01); *G03G 9/08782* (2013.01); *G03G 9/0926* (2013.01)
USPC ..... 430/108.1; 430/108.22; 430/109.4; 430/108.8

(58) Field of Classification Search
USPC ..... 430/108.8, 109.4, 108.22, 108.1
See application file for complete search history.

(56) References Cited

U.S. PATENT DOCUMENTS

| | | | | |
|---|---|---|---|---|
| 5,384,224 | A * | 1/1995 | Tanikawa et al. | 430/108.8 |
| 6,284,421 | B1 * | 9/2001 | Matsuzaki et al. | 430/111.1 |
| 6,310,117 | B1 * | 10/2001 | Sawada et al. | 523/200 |
| 6,495,302 | B1 | 12/2002 | Jiang et al. | |
| 7,037,633 | B2 | 5/2006 | Hopper et al. | |

(Continued)

FOREIGN PATENT DOCUMENTS

| | | |
|---|---|---|
| EP | 0662 640 A2 | 7/1995 |
| EP | 1 760 536 A2 | 3/2007 |

(Continued)

OTHER PUBLICATIONS

Diamond, Handbook of Imaging Materials, Marcel Dekker, Inc., New York, 2002, pp. 145-164.*

(Continued)

*Primary Examiner* — Mark F Huff
*Assistant Examiner* — Rashid Alam
(74) *Attorney, Agent, or Firm* — Oliff PLC

(57) ABSTRACT

The invention provides a transparent toner for developing an electrostatic latent image, including a binder resin and a release agent, the difference between the endothermic peak Tm of the release agent in a temperature increasing process and the exothermic peak Tc of the release agent in a temperature decreasing process being from about 10° C. to about 50° C., where Tm and Tc are measured with a differential scanning calorimeter (DSC) according to the ASTM method.

14 Claims, 2 Drawing Sheets

(56) References Cited

U.S. PATENT DOCUMENTS

| | | | | |
|---|---|---|---|---|
| 8,389,187 | B2 | 3/2013 | Kadokura et al. | |
| 2005/0214669 | A1* | 9/2005 | Hayashi et al. | 430/109.4 |
| 2005/0287460 | A1* | 12/2005 | Moffat et al. | 430/108.22 |
| 2006/0040194 | A1 | 2/2006 | Sugiura et al. | |
| 2006/0172211 | A1 | 8/2006 | Ueda et al. | |
| 2006/0275058 | A1 | 12/2006 | Omata | |
| 2007/0048653 | A1 | 3/2007 | Ide | |
| 2007/0087281 | A1 | 4/2007 | Patel et al. | |
| 2007/0111128 | A1* | 5/2007 | Patel et al. | 430/108.4 |
| 2007/0172752 | A1* | 7/2007 | Niimi | 430/123.43 |
| 2008/0090163 | A1 | 4/2008 | Agur et al. | |
| 2008/0199797 | A1* | 8/2008 | Sacripante et al. | 430/104 |
| 2009/0017392 | A1* | 1/2009 | Higuchi et al. | 430/108.8 |
| 2010/0209835 | A1 | 8/2010 | Takahashi et al. | |

FOREIGN PATENT DOCUMENTS

| | | |
|---|---|---|
| JP | A 10-73952 | 3/1998 |
| JP | A-10-301322 | 11/1998 |
| JP | A-2003-241414 | 8/2003 |
| JP | A-2005-099122 | 4/2005 |
| JP | A-2006-243714 | 9/2006 |
| JP | A-2007-011293 | 1/2007 |
| JP | A-2007-057718 | 3/2007 |
| JP | A-2007-178467 | 7/2007 |
| JP | A-2007-240615 | 9/2007 |
| JP | A-2008-129410 | 6/2008 |
| JP | A-2008-209807 | 9/2008 |

OTHER PUBLICATIONS

European Search Report issued for European Application No. 09 17 2931.9 on Jun. 4, 2010.
Japanese Office Action issued in Japanese Patent Application No. 2009-009185 dated Oct. 19, 2010 (with translation).
Jun. 8, 2012 Office Action issued in U.S. Appl. No. 12/582,326.
Feb. 7, 2013 Office Action issued in U.S. Appl. No. 12/582,326.
Jun. 26, 2013 Office Action issued in U.S. Appl. No. 12/582,326.
Dec. 2, 2013 Office Action issued in U.S. Appl. No. 12/582,326.
Jun. 29, 2012 Office Action issued in U.S. Appl. No. 12/567,094.

* cited by examiner

TRANSPARENT TONER FOR DEVELOPING ELECTROSTATIC LATENT IMAGE, ELECTROSTATIC LATENT IMAGE DEVELOPER, TONER CARTRIDGE, PROCESS CARTRIDGE, IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2009-009185 filed on Jan. 19, 2009.

BACKGROUND

1. Technical Field

The present invention relates to a transparent toner for developing an electrostatic latent image, an electrostatic latent image developer, a toner cartridge, a process cartridge, an image forming apparatus and an image forming method.

2. Related Art

Methods for visualizing image information using an electrostatic latent image such as an electrophotographic method are currently used in many fields. In the electrophotographic method, image information is visualized as an image through steps including a charging and exposing step that forms an image information as an electrostatic latent image on the surface of a latent image holding member (photoreceptor) a transfer step that transfers the toner image which has been formed on the surface of the photoreceptor using a developer containing a toner to a recording medium (receiving material), and a fixing step that fixes the toner image onto the surface of the recording medium.

Color image formation using a color electrophotographic method there has been a great increase in numbers in recent years is performed by reproducing color, generally using four color toners including subtractive three primary colors, namely yellow, magenta and cyan and black toner.

In general color electrophotographic method, first, a manuscript (image information) is decomposed into colors of yellow, magenta, cyan and black to form an electrostatic latent image of each color on the surface of a photoreceptor. Then, the electrostatic latent image formed for each color is developed, using a developer containing each color toner, to form a toner image. The toner image is then transferred onto the surface of a recording medium through a transfer step. A series of steps from the formation of an electrostatic latent image to the transfer of a toner image onto the surface of a recording medium are sequentially carried out for each color, so that the toner images of the individual colors are overlaid and transferred onto the surface of the recording medium. In such manner, the colored toner image obtained by transferring toner image with each color onto the surface of the recording medium is fixed through a fixing step to give a color image.

For forming such color image, attempts have been made for correcting the gloss difference on the in-plane of the image, controlling gloss on the surface of a transfer paper, and correcting between image concentration and an applied amount of the toner, using a transparent toner in addition to conventional Y (yellow), M (magenta) and C (cyan), and BK (black) toners.

SUMMARY

According to an aspect of the present invention, there is provided a transparent toner for developing an electrostatic latent image, including a binder resin and a release agent, the difference between the endothermic peak Tm of the release agent in a temperature increasing process and the exothermic peak Tc of the release agent in a temperature decreasing process being from about 10° C. to about 50° C., where Tm and Tc are measured with a differential scanning calorimeter (DSC) according to the ASTM method.

BRIEF DESCRIPTION OF THE DRAWINGS

Exemplary embodiments of the present invention will be described in detail, based on the following figures, wherein.

DETAILED DESCRIPTION

Figure 1:
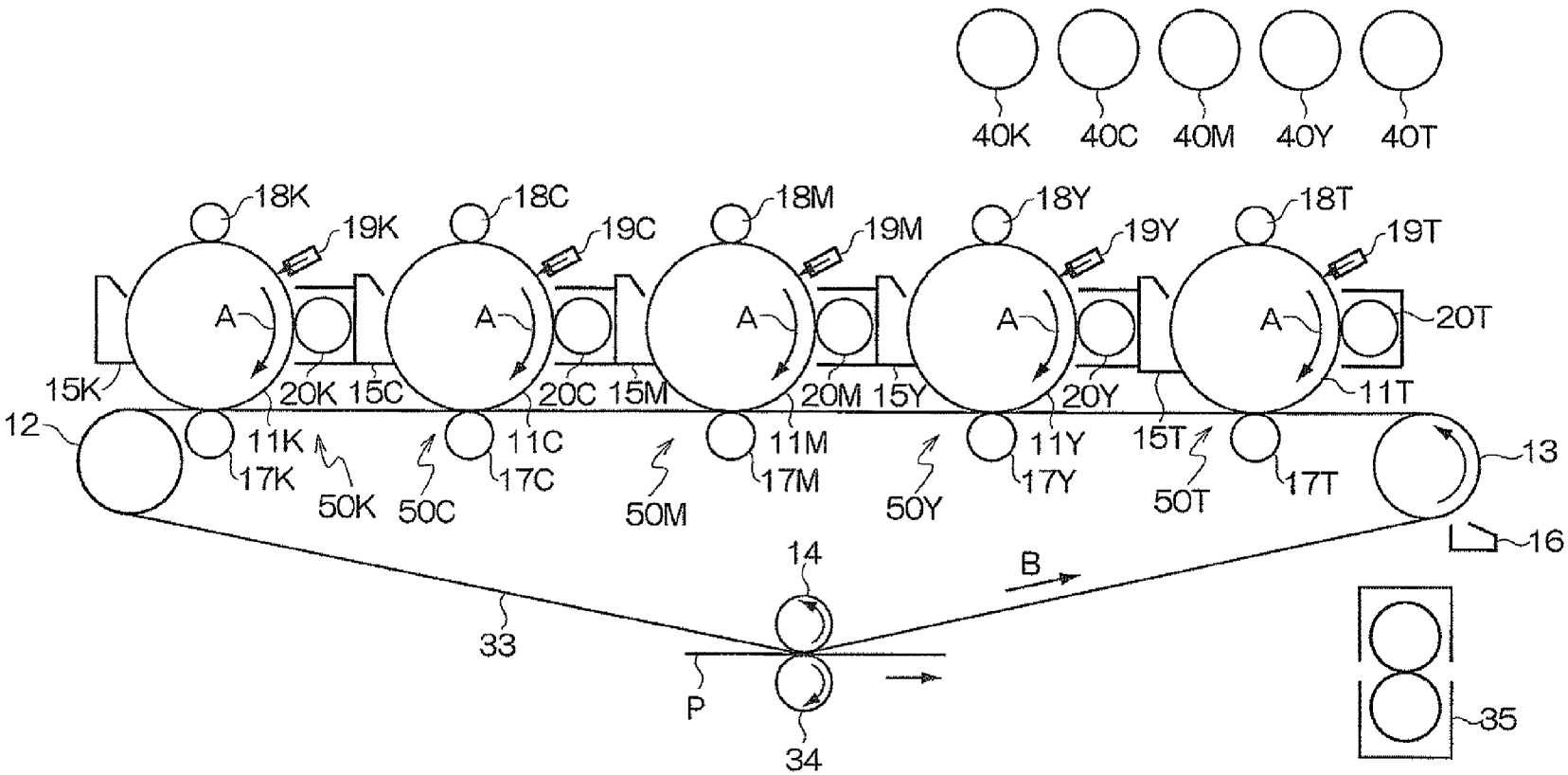
FIG. 1 is a schematic constitutive view showing one example of the image forming apparatus according to an exemplary embodiment of the invention.

Hereinafter a transparent toner for developing an electrostatic latent image, an electrostatic latent image developer, a toner cartridge, a process cartridge, an image forming apparatus and an image forming method according to an exemplary embodiment of the invention will be described in detail.

<Transparent Toner for Developing an Electrostatic Latent Image>

The transparent toner for developing an electrostatic latent image according to an exemplary embodiment of the invention (hereinafter, referred to as "toner" in some cases) includes a binder resin and a release agent, the difference between the endothermic peak Tm of the release agent in a temperature increasing process and the exothermic peak Tc of the release agent in a temperature decreasing process is from 10° C. or about 10° C. to 50° C. or about 50° C., where Tm and Tc are measured with a differential scanning calorimeter (DSC) according to the ASTM method.

In the exemplary embodiment, the term "transparent toner" means a toner for use in forming a transparent toner image and specifically includes an substantially colorless toner, where the content of colorants such as dyes or pigments is 0.01% by weight or about 0.01% by weight or less.

In a case that the difference between Tm and Tc is less than 10° C., the difference indicates that the crystallizability of the release agent is high (the release agent is readily crystallizable during cooling of the release agent). In a case that the difference is 10° C. or more, the difference indicates that the crystallizability during cooling is low (the release agent is hardly crystallizable even when the release agent is cooled), demonstrating the existence of some factor inhibiting the crystallization.

Despite the production methods such as kneading grinding method, emulsification aggregation method (EA method) and suspension polymerization method, the release agent in a color toner such as conventional cyan toner, magenta toner, yellow toner or black toner is hardly miscible with the binder resin and colorant in the toner, so the crystallizability of such release agent is hardly impaired. When the toner is measured with DSC, Tm (endothermic peak) and Tc (exothermic peak) derived from such release agent are generally at almost the same temperature. In the case that the difference between Tm and Tc is less than 10° C. and when the release agent which has been melted by heating is cooled, the crystal of the release agent readily grows. Due to crystal growth of the release agent, the crystal shape of the release agent becomes flat.

When crystal growth of the release agent arises, the crystal shape of the release agent in a transparent toner becomes flat similarly as in the color toners. In particular, when a fixed image is cooled slowly, the crystal growth of the release agent in the fixed image allows the domain diameter of the release agent to be enlarged, and the domain of the release agent easily takes the form of a flat shape. Since incident light to the color toners is reflected on the surface of the fixed image, gloss unevenness is not problematic regardless of the crystal shape of the release agent. However, incident light to a transparent toner passes through a transparent fixed image, so that the light is reflected on the surface of a paper (receiving material) on which the release agent in the transparent toner or the transparent toner has been fixed. When the crystal shape of the release agent in the transparent toner is flat, scattered reflection of light occurs, which may be recognized as gloss unevenness when the toner layer forming the fixed image is thick.

According to the invention described in JP-A No. 10-73952, suppose that a transparent toner is prepared without using colorants, it is impossible to suppress the crystallization of the release agent in the fixed image by way of fixing the ratio of branched carbons to a predetermined value, so that the crystal shape of the release agent may sometimes be flat. For example, in the transparent toner using FNP 0090 (trade name, manufactured by Nippon Seiro Co., Ltd.), the difference between Tm and Tc is 5° C., so that when the release agent which has been melted by heating is cooled slowly, the crystal shape of the release agent readily becomes flat, which is readily observable as gloss unevenness on the resulting fixed image.

As a method for suppressing the gloss unevenness on the fixed transparent toner, a method for maintaining the crystal shape of the release agent in the fixed image as a spherical shape is exemplified, so as to suppress the scattered reflection of incident light at the release agent. However, general release agents cause crystal growth. Therefore, conventionally, there has been no way to suppress the crystal growth in order to prevent the crystal shape of the release agent from becoming flat. Methods for suppressing the crystal growth include a method comprising adding a crystallization inhibitor. In the method comprising adding a crystallization inhibitor, the crystallization inhibitor exists in the binder resin, so that an effect from an outer side toward the domain of a release agent can be obtained. However, the crystal growth of the release agent arises along all directions, so it is substantially difficult to suppress the crystal growth from the outer side of the domain of the release agent. Hence, such a method does not work as a method for suppressing gloss unevenness.

In the exemplary embodiment of the invention, the difference between Tm and Tc is from 10° C. or about 10° C. to 50° C. or about 50° C., so that the crystal growth of the release agent contained in the transparent toner is suppressed, which controls the crystal shape of the release agent so as not to become flat. In such a manner, the gloss unevenness of the fixed transparent toner can be suppressed. Especially, in double-sided printing, gloss unevenness is likely to occur on the precedent face at the time of printing the subsequent face. By using the toner according to the exemplary embodiment of the invention, the occurrence of gloss unevenness on the precedent face at the time of printing the subsequent face is effectively suppressed.

Herein, the term "precedent face" means a side of a paper on which fixation is performed first in double-sided printing, while the term "subsequent face" means another side of the paper on which fixation is performed later than that of the precedent face in double-sided printing.

When the difference between Tm and Tc is less than 10° C., the suppression of gloss unevenness becomes difficult. In addition, although gloss unevenness may be suppressed even when the difference between Tm and Tc exceeds 50° C., it is technically difficult to make the difference between Tm and Tc larger than 50° C.

Tm and Tc, which are to be measured with a differential scanning calorimeter (DSC) according to the ASTM method (D3418-8), are determined by the following method. 1) 10 mg of a sample is placed in an aluminum cell, and the cell is covered with a lid (the cell is referred to as a "sample cell" hereinafter). For comparison, 10 mg of alumina is placed in an aluminum cell of the same type, and the cell is covered with a lid (referred to as a "comparative cell" hereinafter). 2) The sample cell and the comparative cell are set in the calorimeter, a temperature of the calorimeter is increased from 30° C. to 200° C. at a rate of temperature increase of 10° C./min under a nitrogen atmosphere, and then the cells are left to stand at 200° C. for 10 minutes. 3) After that, the temperature is decreased to −30° C. at a rate of temperature decrease of −10° C./min by using liquid nitrogen, and then the cells are left to stand at −30° C. for 10 minutes. 4) After that, the temperature is increased from −30° C. to 200° C. at a rate of temperature increase of 20° C./min. During the process of 4), an endothermic curve and an exothermic curve are determined. From the endothermic and exothermic curves, Tm and Tc are determined. As the calorimeter, a differential scanning calorimeter DSC-7 (trade name, manufactured by Perkin Elmer Co., Ltd.) is used.

Incidentally, in the obtained endothermic and exothermic curves, whether or not the Tm and Tc are derived from the release agent contained in the toner is judged in the following manner.

In the first place, the toner is dissolved in toluene heated to 180° C., and then the mixture is cooled to batch off the crystallized release agent alone. The endothermic peak of the thus obtained release agent in a temperature increasing process is determined with the DSC in the same manner as described above. When Tm of the toner coincides with the endothermic peak of the release agent alone, it can be determined that the Tm of the toner is derived from the release, agent contained in the toner.

Then, toluene remaining in the toluene in which the toner has been dissolved at the time of batching off of the release agent alone is evaporated, and the exothermic peak of the residual solids is determined in a temperature decreasing process with DSC in the same manner as described above. Since the exothermic peaks thus obtained are considered to be derived from materials other than the release agent, Tc of the toner other than these peaks can be judged to be derived from the release agent.

In the exemplary embodiment of the invention, metal elements such as Al may preferably be contained in the domain of the release agent in the toner in view of the difference between Tm and Tc being controlled in the range of from 10° C. or about 10° C. to 50° C. or about 50° C. Metal elements such as Al have a function as a crystallization inhibitor for the release agent. Further, metal elements such as Al bind to a binder resin in the toner via ionic bonds, so that the metal elements have an effect of inhibiting crystal growth of the release agent. In such a manner, the occurrence of gloss unevenness after fixing can be effectively prevented.

The metal elements contained in the domain of the release agent may preferably be Al since Al has a large valence so as to suppress the crystallization of the release agent effectively via the ionic bonds.

The method for allowing the domain of the release agent to contain metal elements such as Al will be described below.

Incidentally, whether or not metal elements such as Al are contained in the domain of the release agent is determined by the following method.

First, toner particles are embedded in a bisphenol A liquid epoxy resin with a curing agent, to prepare a cutting sample. Using a cutting machine with a diamond knife, for example LEICA ultra-microtome (trade name, manufactured by Hitachi Technologies Co., Ltd.), the cutting sample is cut at −100° C. to prepare an observation sample. Further, the observation sample is left to stand in a desiccator under a ruthenium tetraoxide atmosphere, for staining. The staining level can be determined on the basis of the staining level of a tape which is simultaneously left to stand together with the observation sample. The observation sample stained in such a manner can be observed with a TEM at around 5,000-fold magnification.

Since the toner sample is stained with ruthenium tetraoxide, the binder resin and the release agent can be discriminated from each other, on the basis of the staining levels or the shapes. The parts in the shape of rod or agglomerate, having a whiter contrast within the toner are determined as the domain of the release agent.

Then, mapping of the observation sample is performed by using an X ray analyzer of an energy dispersion type, EMAX model 6923H (trade name, manufactured by Horiba, Ltd.) equipped with an electron microscope S4100, at an acceleration voltage of 20 kV to determine whether or not metal elements such as Al are contained in the domain of the release agent.

The Al content in the domain of the release agent in the toner as measured by X ray fluorescence spectrometry is preferably from 0.005 atom % or about 0.005 atom % to 0.1 atom % or about 0.1 atom %, more preferably from 0.005 atom % or about 0.005 atom % to 0.05 atom % or about 0.05 atom % and particularly preferably from 0.01 atom % or about 0.01 atom % to 0.05 atom % or about 0.05 atom %.

When Al content is less than 0.005 atom %, the crystal growth of the release agent may sometimes not be suppressed and the gloss unevenness may sometimes not be suppressed. When Al content exceeds 0.1 atom %, although crystal growth of the release agent can be suppressed, due to suppression of melting the release agent, the peeling property between a receiving material and a fixing member may be deteriorated. In particular, in a low-temperature fixing or under a condition of a process speed at 500 mm/s, the peeling property may be particularly deteriorated, thus such a toner is not preferable. When Al content in the domain of the release agent is within the range described above, the occurrence of gloss unevenness after fixing can be more effectively prevented.

The term "low-temperature fixing" in the exemplary embodiment of the invention means that the toner is fixed by heating at around 120° C. or less.

Hereinafter, each component which constitutes the toner of the exemplary embodiment will be described.

The toner of the exemplary embodiment includes a binder resin and a release agent, and additionally contains other additives if necessary.

(Binder Resin)

The toner of the exemplary embodiment comprises a binder resin. The type of the binder resin is not specifically limited, and known crystalline resins and noncrystalline resins may satisfactorily be used. A crystalline resin and a noncrystalline resin may be used in combination.

—Binder Resin—

The binder resin includes for example polyester resins, polyalkylene resins, and long-chain alkyl (meth)acrylate resins. In view of the fact that a rapid change in viscosity is more likely to occur by heating, and of the compatibility between mechanical strength and fixability, polyester resins are desirably used.

As a representative example of the binder resin, polyester resins are mainly described hereinbelow.

The melting temperature of polyester resins for use in the exemplary embodiment is preferably in the range of from 50° C. or about 50° C. to 100° C. or about 100° C., more preferably from 55° C. or about 55° C. to 90° C. or about 90° C., and still more preferably from 60° C. or about 60° C. to 85° C. or about 85° C., in terms of the storability and the low-temperature fixability. When the melting temperature thereof is lower than 50° C., the storability of toners may be deteriorated, for example, blocking may be occurred in the storage toner or the storability of fixed image after fixing may get poor. When the melting temperature exceeds 100° C., sufficient fixability may not be obtained.

The melting temperature and glass transition temperature of the polyester resins are determined on the basis of the peak temperature of the endothermic peak obtained by the above described method using the differential scanning calorimeter (DSC).

In the exemplary embodiment, the term "polyester resins" means polymers consisting of a 100% polyester structure as the constitutive component, and also means polymers (copolymers) prepared by copolymerizing components composing polyester with the other components. In case of the latter, herein, a ratio of the other components composing the polymers (copolymers), except polyester, is 50% by weight or less.

The polyester resins for use in the toner of the exemplary embodiment are synthetically prepared from for example polyvalent carboxylic acid component and polyhydric alcohol component. In the exemplary embodiment, commercially available crystalline polyester resins may be used as the crystalline polyester resins. Otherwise, synthetically prepared crystalline polyester resins may also be used.

Examples of polyvalent carboxylic acid component include aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, 1,18-octadecanedicarboxylic acid malonic acid, and mesaconic acid; aromatic dicarboxylic acids such as dibasic acids including phthalic acid, isophthalic acid, terephthalic acid, and naphthalene-2,6-dicarboxylic acid; and anhydrides thereof and lower alkyl esters thereof, but are not limited thereto.

Examples of Carboxylic acids of trivalent or more include specific aromatic carboxylic acids such as 1,2,3-benzenetricarboxylic acid, 1,2,4-benzenetricarboxylic acid, and 1,2,4-naphthalenetricarboxylic acid; and anhydrides thereof and lower alkyl esters thereof. These may be used singly or may be used in combination of two or more.

As the polyhydric alcohol components, aliphatic diols are preferable; and linear-chain aliphatic diols having 7 or about 7 to 20 or about 20 carbon atoms in the main chain structure thereof are more preferable. When the aliphatic diol is of branched type, the crystallizability of the polyester resins is deteriorated, so that the melting temperature may be decreased. When the carbon atoms in the main chain structure are less than 7, the melting temperature gets higher in case of condensation polymerization with aromatic dicarboxylic acids, so that the low-temperature fixing may become difficult. When the carbon atoms in the main chain structure exceed 20, practical materials are hardly available. The number of carbon atoms in the main chain structure is more preferably 14 or less.

Specific examples of aliphatic diols preferable for use in the synthetic preparation of the crystalline polyester for use in the toner of the exemplary embodiment include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,14-eicosadecanediol but are not limited thereto. Among them, 1,8-octanediol, 1,9-nonanediol and 1,10-decanediol are preferable from the standpoint of ready availability.

Examples of alcohols with trivalent or more include glycerin, trimethylolethane, trimethylolpropane, and pentaerythritol. These may be used singly or in combination of two or more.

The content of the aliphatic diols in the polyhydric alcohol components is preferably 80 mol % or more, more preferably 90 mol % or more. When the content of the aliphatic diols is less than 80 mol %, the glass transition temperature is decreased, which sometimes induces the deterioration of the toner blocking resistance, the image storability and the fixability.

Examples of catalysts usable in producing the polyester resins include compounds of alkali metal such as sodium and lithium; compounds of alkali earth metals such as magnesium and calcium; compounds of metals such as zinc, manganese, antimony, titanium, tin, zirconium and germanium; phosphite compounds; phosphate compounds and amine compounds.

Specific examples of the catalysts include compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyltin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octate, germanium oxide, triphenyl phosphite, tris(2,4-di-t-butylphenyl) phosphite, ethyltriphenylphosphonium bromide, triethylamine, and triphenylamine.

The acid value (the weight in unit mg of KOH required for neutralizing 1 g of the resin) of the polyester resin for use in this exemplary embodiment is preferably in the range of from 3.0 mg KOH/g or about 3.0 mg KOH/g to 30.0 mg KOH/g or about 30.0 mg KOH/g, more preferably from 6.0 mg KOH/g or about 6.0 mg KOH/g to 25.0 mg KOH/g or about 25.0 mg KOH/g, and still more preferably from 8.0 mg KOH/g or about 8.0 mg KOH/g to 20.0 mg KOH/g or about 20.0 mg KOH/g. In the exemplary embodiment, the acid value is measured according to JIS K-0070-1992.

When the acid value is smaller than 3.0 mg KOH/g, the dispersibility in water is lowered, so that it is sometimes difficult to prepare an emulsified particle by a wet process. Further, since the stability of the emulsified particle during aggregation is significantly deteriorated, it is sometimes hard to efficiently prepare the toner. When the acid value exceeds 30.0 mg KOH/g, the hygroscopicity of the resulting toner is increased, so that the charging property of the toner is readily influenced by environment.

Preferably, the weight average molecular weight (Mw) of the polyester resin is from 6,000 or about 6,000 to 35,000 or about 35,000. When the molecular weight (Mw) is less than 6,000, the toner may infiltrate into the surface of a recording medium such as paper at the time of fixing to cause fixing unevenness; otherwise, the strength of the resulting fixed image against bending resistance may sometimes be lowered. When the weight average molecular weight (Mw) exceeds 35,000, the viscosity at the time of melting gets too large, so that the temperature for yielding the viscosity suitable for fixing may sometimes be high. Thus, consequently, the fixability may sometimes be impaired.

The weight average molecular weight can be determined by gel permeation chromatography (GPC). The molecular weight was determined by GPC, using an apparatus GPC HLC-8120 (trade name, manufactured by TOSOH Corporation) and a column TSK gel Super HM-M (15 cm) (trade name, manufactured by TOSOH Corporation), and THF as a solvent. Based on the results of the measurement, the weight average molecular weight can be calculated on a molecular weight standard curve prepared by using a single dispersion polystyrene standard sample.

The binder resin containing the polyester resin described above preferably contains a polyester resin as a main component (at 50% by weight or more) synthetically prepared from an aliphatic polymerizable monomer. In this case, the constitutive ratio of the aliphatic polymerizable monomer composing the polyester resin is preferably 60 mol % or more, more preferably 90 mol % or more. As the aliphatic polymerizable monomer, aliphatic diols and dicarboxylic acids as described above are preferably used.

(Release Agent)

The toner of the exemplary embodiment contains a release agent. Examples of the release agent include paraffin waxes such as low molecular polypropylene and low molecular polyethylene; silicone resins; rosins; rice wax; carnauba wax, ester wax and montan wax. Among them, paraffin wax, ester wax and montan wax are preferable. Still more preferable are paraffin wax and ester wax. The melting temperature of the release agent for use in the exemplary embodiment is preferably from 70° C. or about 70° C. to 120° C. or about 120° C., more preferably from 70° C. or about 70° C. to 110° C. or about 110° C. in view of the difference between Tm and Tc being controlled in the range of from 10° C. or about 10° C. to 50° C. or about 50° C. The content of the release agent in the toner is preferably from 0.5% by weight or about 0.5% by weight to 15% by weight or about 15% by weight, more preferably from 1.0% by weight or about 1.0% by weight to 12% by weight or about 12% by weight. When the content of the release agent is less than 0.5% by weight, the releasability during oil-less fixing potentially gets poor. When the content of the release agent exceeds 15% by weight, the image quality and the image forming reliability may potentially be deteriorated, which is exemplified by the deterioration of the toner fluidity.

(Other Additives)

In addition to the components described above, various components such as internal additives, charge controlling agents, inorganic powders (inorganic particles) and organic particles may be added to the toner of the exemplary embodiment.

Examples of the internal additives include magnetic materials such as metals including ferrite, magnetite, reduced iron, cobalt, nickel, and manganese, and alloys or compounds containing these metals.

The inorganic particles are added for various purposes. The inorganic particles may be added for adjusting the visco-elasticity of the toner. Via the adjustment of the visco-elasticity, image gloss levels and infiltration into paper can be adjusted. As the inorganic particles, known inorganic particles such as silica particle, titanium oxide particle, alumina particle, cerium oxide particles or products obtained by hydrophobicizing treatments of the surfaces thereof may be used singly or in combination of two or more thereof. From the standpoint of no deterioration of color development or transparency such as OHP transmissibility, a silica particle of a refractive index smaller than that of the binder resin is preferably used. In addition, silica particles may be treated by various surface treatment processes. Such silica particle of the surface treated with silane-based coupling agents, titanium-based coupling agents, or silicone oil is preferably used.

(Properties of the Toner)

The volume average particle diameter of the toner of the exemplary embodiment is preferably in the range of from 4 μm or about 4 μm to 9 μm or about 9 μm, more preferably from 4.5 μm or about 4.5 μm to 8.5 μm or about 8.5 μm, still more preferably from 5 μm or about 5 μm to 8 μm or about 8 μm. When the volume average particle diameter is smaller than 4 μm, the toner fluidity is reduced, which readily induces the reduction of the charging property of each particle. Since the charge distribution is spread, background fogging and toner leakage from a developing vessel readily occur. Further when the volume average molecular size is smaller than 4 μM, the cleanability may sometimes get tough. When the volume average particle diameter exceeds 9 μm, the resolution is reduced, so that the sufficient image quality may not be obtained. Hence, it is sometimes difficult to satisfy the recent demand toward high image quality.

The volume average particle diameter can be measured using Coulter Multi-sizer II (trade name, manufactured by Coulter Company), with an aperture diameter of 50 μm. In this case, the toner is dispersed in an aqueous electrolyte solution (aqueous Isoton solution) by ultrasonication for 30 seconds or more, and then used for the measurement.

The toner of the exemplary embodiment is preferably a spherical shape having a shape factor SF1 of from 110 or about 110 to 140 or about 140. When the toner has a spherical shape, where the shape factor is within the above range, the transfer efficiency and the density of the resulting image are improved, to form a high-quality image.

The shape factor SF1 is more preferably in the range of from 110 or about 110 to 130 or about 130.

The shape factor SF1 can be determined according to the following formula (1).

$$SF1=(ML^2/A)\times(\pi/4)\times 100 \qquad \text{Formula (1)}$$

In the formula (1), ML represents the absolute maximum length of the toner; and A represents the projected area of the toner.

The SF1 is expressed as a numerical figure by using an image analyzer to analyze a microscopic image or a scanning electron microscope (SEM) image and calculating, for example, in the following manner. Specifically, an optical microscopic image of particles spread on the surface of a slide glass is input into a Luzex image processor via a video camera to determine the maximum lengths and projected areas of 100 particles. Then, the SF1 is determined by calculation according to the formula (1) to determine the average thereof.

The toner of the exemplary embodiment may compose a toner set together with at least one color toner selected from cyan toner, magenta toner, yellow toner and black toner.

The colorant for use in the color toner may be a dye or a pigment. In view of light resistance and water resistance, pigment is preferable.

Examples of preferable colorant include known pigments such as carbon black, Aniline Black, Aniline Blue, Calco Oil Blue, Chrome Yellow, Ultramarine Blue, Du Pont Oil Red, Quinoline Yellow, Methylene Blue Chloride, Phthalocyanine Blue, Malachite Green Oxalate, Lamp Black, Rose Bengale, quinacridone, benzidine yellow, C. I. Pigment Red 48:1, C. I. Pigment Red 57:1, C. I. Pigment Red 122, C. I. Pigment Red 185, C. I. Pigment Red 238, C. I. Pigment Yellow 12, C. I. Pigment Yellow 17, C. I. Pigment Yellow 180, C. I. Pigment Yellow 97, C. I. Pigment Yellow 74, C. I. Pigment Blue 15:1, and C. I. Pigment Blue 15:3.

The content of the colorants in the color toner is preferably in the range of from 1 part by weight to 30 parts by weight with respect to 100 parts by weight of the binder resin. If necessary, a surface-treated colorant or a dispersion of a pigment may also be used effectively. By selecting the type of the colorant, for example, yellow toner, magenta toner, cyan toner and black toner may be obtained.

The color toner of the exemplary embodiment may contain the same components as those for the toner (transparent toner) of the exemplary embodiment in addition to the colorants. In addition, the preferable ranges such as particle size regarding the properties of the toner are also the same as those for the toner of the exemplary embodiment.

<Method for Manufacturing Toner>

Method for manufacturing the toner of the exemplary embodiment is not specifically limited. The toner may be manufactured by known methods including dry processes such as kneading and grinding process and wet processes such emulsification aggregation method and suspension polymerization. Among these methods, the emulsification aggregation method is preferable because a toner of a core-shell structure can be readily prepared by the method. The method for producing the toner of the exemplary embodiment by the emulsification aggregation method is described in detail hereinbelow.

The emulsification aggregation method of the exemplary embodiment includes an emulsification step of emulsifying raw materials composing the toner to form a resin particle (emulsified particle), an aggregation step of forming an aggregate of the resin particle and a fusion step of fusing the aggregate together.

(Emulsification Step)

A dispersion of a crystalline resin particle may be prepared for example by giving a shear force to a mixture solution of an aqueous medium and a crystalline resin with a dispersing machine. In this case, the viscosity of the resin component may be reduced by heating to form the particle. In order to stabilize the resin particle in dispersion, a dispersant may also be used. Further, in the case when the crystalline resin is oily and can be dissolved in a solvent with a relatively low solubility in water, the resin is dissolved in the solvent to disperse the particle, together with a dispersant and a high molecular electrolyte, in water, which is then heated or pressure-reduced to evaporate the solvent therein, to prepare a dispersion of the crystalline resin particle. In the same manner as described above, a non-crystalline resin may also be prepared as a dispersion of the non-crystalline resin particle.

Examples of the aqueous solvent include water such as distilled water and ion exchange water; and alcohols. Preferably, the aqueous solvent is singly water.

Examples of the dispersant for use in the emulsification step include water-soluble polymers such as polyvinyl alcohol, methylcellulose, ethylcellulose, hydroxyethylcellulose, carboxymethylcellulose, sodium polyacrylate, and sodium polymethacrylate; surfactants for example anionic surfactants such as sodium dodecylbenzenesulfonate, sodium octadecyl sulfate, sodium oleate, sodium laurate, and potassium stearate; cationic surfactants such as laurylamine acetate, stearylamine acetate, and lauryltrimethylammonium chloride; amphoteric surfactants such as lauryldimethylamine oxide; and nonionic surfactants such as polyoxyethylene alkyl ether, polyoxyethylene alkyl phenyl ether and polyoxyethylene alkylamine; inorganic salts such as tricalcium phosphate, aluminium hydroxide, calcium sulfate, calcium carbonate and barium carbonate.

Examples of the dispersing machine for use in preparing the emulsion include homogenizer, homomixer, pressure kneader, extruder and media dispersing machine. As to the size of the resin particle, the average particle diameter (the volume average particle diameter) thereof is preferably 1.0 μm or less and is more preferably within the range of from 60 nm to 300 nm and still more preferably from 150 nm to 250 nm. When the average particle diameter is less than 60 nm, the resin particle turns a stable particle in the dispersion, so that the resin particle sometimes hardly aggregates together. When the average particle diameter exceeds 1.0 μm, the aggregation potency of the resin particle is so enhanced that the toner particle is readily prepared. However, the particle size distribution of the toner may be enlarged.

For preparing the dispersion of the release agent, the release agent is dispersed together with ionic surfactants and polymeric electrolytes such as polymeric acids and polymeric bases in water; then, while the resulting dispersion is heated to a temperature equal to or higher than the melting temperature of the release agent, the dispersion is dispersed with a homogenizer or a dispersing machine of a pressure ejection type which can give a strong shear force. Through such treatments, the dispersion of the release agent can be obtained. During the dispersing treatment, it is possible to allow the release agent to contain metal elements such as Al by adding inorganic compounds such as poly(aluminium chloride) to the dispersion. The inorganic compounds preferably include for example poly(aluminium chloride), aluminum sulfate, highly basic poly(aluminium chloride), poly(aluminium hydroxide), and aluminium chloride. Among them, poly(aluminium chloride) and aluminium sulfate are preferable. The dispersion of the release agent is used for the emulsification aggregation method. The dispersion of the release agent may also be used for preparing the toner by the suspension polymerization method.

By the dispersion treatment, the dispersion of the release agent containing the particles of the release agent, each having a volume average particle diameter of 1 μm or less can be obtained. The volume average particle diameter of the particles of the release agent is more preferably from 100 nm to 500 nm.

When the volume average particle diameter is less than 100 nm, generally, the release agent component is hardly incorporated in the toner, although the incorporation depends on the characteristic profile of the binder resin used. When the volume average particle diameter exceeds 500 nm, the dispersion state of the release agent in the toner sometimes gets insufficient.

(Aggregation Step)

In the aggregation step, a dispersion of a crystalline resin particles, a dispersion of a non-crystalline resin particles, the dispersion of the release agent and the like are mixed together to prepare a mixed solution, which is then heated at a temperature of the glass transition temperature of the non-crystalline resin particle or less for aggregation, to prepare an aggregated particle. The aggregated particle is formed by adjusting the mixture solution to acidic pH under agitation. The pH is preferably in the range of from 2 to 7, more preferably from 2.2 to 6, and still more preferably from 2.4 to 5. In this time, a coagulant may also be used effectively.

In the aggregation step, the dispersion of the release agent may be added and mixed together with various dispersions such as the dispersion of the resin particle at once or may be divided in plural portions, and added.

As a coagulant, divalent metal complexes or more valency other than surfactants having reverse polarity to that of the surfactants used in the dispersing agent as well as inorganic metal salts may preferably be used. In particular, metal complexes are particularly preferably used, since the amount of the surfactants to be used can be reduced, whereby improves the charging property.

Examples of the inorganic metal salts include metal salts such as calcium chloride, calcium nitrate, barium chloride, magnesium chloride, zinc chloride, aluminium chloride, and aluminium sulfate; and polymers of inorganic metal salts, such as poly(aluminium chloride), poly(aluminium hydroxide), and calcium polysulfide. Among them, the aluminium salts and the polymers thereof are particularly preferable. In order to obtain a sharper particle size distribution, an inorganic divalent metal salt rather than single valence, of trivalence rather than divalence, of tetravalence rather than trivalence is more suitable, while a polymer of an inorganic metal salt is more suitable than the inorganic metal salt of the same valence.

In this exemplary embodiment, a polymer of a tetravalent inorganic metal salt containing aluminium is preferably used to obtain a sharper particle size distribution.

By adding additional resin particles at the time when the aggregate particle reaches the desired particle size (coating step), a toner may be prepared where the surface of the core aggregate particle is coated with the resin particles. In this case, the release agent is scarcely exposed to the toner surface, which is a preferable structure from the viewpoint of charging property or development property. In case of additional addition, a coagulant may be added before the additional addition or the pH may be adjusted.

(Fusion Step)

At the fusion step, the progress of the aggregation is terminated by raising the pH of the suspension of the aggregated particle under agitation conditions according to the conditions at the aggregation step to the range of from 3 to 9. Then the aggregated particles are fused by heating at a temperature equal to or higher than the melting temperature of the crystalline resin. In a case that the core aggregated particles are coated with the noncrystalline resin, the non-crystalline resin fuses in the same manner to coat the core aggregated particle. The heating time may be a time period to allow for the fusion, which is from about 0.5 hour to about 10 hours.

The fused particle is obtained by cooling after fusion. At the cooling step, the crystallization may be promoted by reducing, the cooling speed around the melting temperature of the crystalline resin (melting temperature±10° C.), which is referred to as slow cooling.

The fused particle obtained by fusion can be prepared as the toner particle, after a solid-liquid separation step such as filtration, and, if necessary, a washing step and a drying step.

—External Additives and Internal Additives—

For the purpose of charge adjustment, imparting fluidity, charge exchangeability, and the like, inorganic oxides typically including silica, titania, and aluminium oxide may be added to and adhered to the obtained toner particle. These procedures may be carried out with type V blenders, Henschel mixers, or LODIGE mixers, while the adherent may be done in dividend stages.

Examples of the inorganic particle include a particle of silica, alumina, titanium oxide, barium titanate, magnesium titanate, calcium titanate, strontium titanate, zinc oxide, silica sand, clay, mica, wollastonite, diatomaceous earth, cerium chloride, colcothar, chromium oxide, cerium oxide, antimony trioxide, magnesium oxide, zirconium oxide, silicon carbide, and silicon nitride. Among these, silica particle and/or titania particle is preferable. Particularly, hydrophobicizing-treated silica particle and titania particle are preferable.

The inorganic particles are used for the purpose of enhancing fluidity of the toner. Among the inorganic particles, particles of metatitanic acid $TiO(OH)_2$ may be used to obtain a toner with excellent transparency, good charging property, environmental stability, fluidity, caking resistance, stabilized negative charging property, and stabilized image quality maintenance. The hydrophobicizing-treated metatitanate compound has an electric resistance of $10^{10}$ Ω·cm or more, so that even when the transfer electric field is enhanced, high transferability can be obtained without any occurrence of a toner charged with reverse polarity, whereby preferably used. The volume average particle diameter of the external additives for the purpose of imparting fluidity, is preferably in the range of from 1 nm to 40 nm, more preferably from 5 nm to 20 nm as the primary particle diameter. The volume average particle diameter of the external additives for the purpose of enhancing the transferability, is preferably in the range of from 50 nm to 500 nm. The surface modification such as hydrophobicizing of the particles of these external additives is preferable in view of stabilizing charging property and development property of the toner.

As a method for surface modification, conventionally known methods may be used, specifically including coupling treatments with silane, titanate or aluminate. Any coupling agent may be used with no specific limitation for the coupling treatment. Preferable examples of the coupling agent include silane coupling agents such as methyl trimethoxysilane, phenyl trimethoxysilane, methylphenyl dimethoxysilane, diphenyl dimethoxysilane, vinyl trimethoxysilane, γ-aminopropyl trimethoxysilane, γ-chloropropyl trimethoxysilane, γ-bromopropyl trimethoxysilane, γ-glycidoxypropyl trimethoxysilane, γ-mercaptopropyl trimethoxysilane, γ-ureidopropyl trimethoxysilane, fluoroalkyl trimethoxysilane, and hexamethyldisilazane; titanate coupling agents; and aluminate coupling agents.

If necessary, various additives may be added. Examples of the additives include other fluidizing agents, auxiliary cleaning agents such as polystyrene particle, polymethyl methacrylate particle, and polyvinylidene fluoride; polishing agents for the purpose of removing deposits on photoreceptor, such as zinc stearylamide, and strontium titanate.

The external additives are added in an amount of from 0.1 part by weight to 5 parts by weight with respect to 100 parts by weight of the toner particle, more preferably from 0.3 part by weight to 2 parts by weight. When the amount of the external additives is less than 0.1 part by weight, the toner fluidity may be deteriorated, further the deterioration of charging property and electric charge exchangeability may be observed, so it is not preferable. When the amount of the external additives exceeds 5 parts by weight, the toner particle is in the excessively coated state, so that the excess inorganic oxides transfer to the contact members, causing sometimes secondary disorders.

If necessary, after the external additives are added, coarse particles of the toner may be selectively removed by using ultrasonic sieve machine, vibration sieve machine, wind power sieve machine and the like.

Other than the external additives described above, other components (particles) such as charge controlling agents, organic particles, lubricants and polishing agents may also be added.

As the charge controlling agents, colorless or pale-colored charge controlling agents may preferably be used, without any limitation. Examples of the charge controlling agents include tetra-ammonium salt compounds, nigrosine-based compounds, complex of aluminium, iron or chromium, and triphenylmethane-based pigments.

Examples of the organic particles include particles used as an external additive for toner surface, such as vinyl-based resins, polyester resins and silicone resins. Herein, these inorganic particles and organic particles may also be used as auxiliary fluidizing agents and auxiliary cleaning agents.

Examples of lubricant include fatty acid amides such as ethylenebisstearic amide and oleic amide; and fatty acid metal salts such as zinc stearate and calcium stearate.

Examples of polishing agent include silica, alumina and cerium oxide as described above.

<Electrostatic Latent Image Developer>

The electrostatic latent image developer of the exemplary embodiment contains at least the toner of the exemplary embodiment.

The toner of the exemplary embodiment is used as a single component developer as it is or is used as a two-component developer. In a case that the toner is used as a two-component developer, the toner is mixed with a carrier for use.

The carrier for use in the two-component developer may be any known carrier with no specific limitation. Examples of the carrier include magnetic metals such as iron oxide, nickel and cobalt; magnetic oxides such as ferrite and magnetite; resin-coated carriers with resin-coated layers on the surface of the core material which may be any carrier exemplified above; and magnetic dispersion carriers. Alternatively, the carrier may be a carrier of a resin dispersion type, where a conductive material is dispersed in the matrix resin.

Examples of the coating resins or the matrix resins for use in the carrier include polyethylene, polypropylene, polystyrene, polyvinyl acetate; polyvinyl alcohol, polyvinyl butyral, polyvinyl chloride, polyvinyl ether, polyvinyl ketone, vinyl chloride-vinyl acetate copolymer, styrene-acrylic acid copolymer, and straight silicone resins comprising organosiloxane bonds and modified products thereof, fluorine resins, polyester, polycarbonate, phenol resins, and epoxy resins but are not limited thereto.

Examples of the conductive material include metals such as gold, silver and copper, as well as titanium oxide, zinc oxide, barium sulfate, aluminium borate, potassium titanate, tin oxide, and carbon black, but the conductive material is not limited thereto. As the conductive material, a white conductive material such as zinc oxide or titanium oxide is preferable. In the case where the white conductive material is used, carrier pieces are hardly visible in the toner image when the carrier pieces have been transferred onto the receiving material.

Examples of the core material of the carrier include magnetic metals such as iron, nickel and cobalt; magnetic oxides such as ferrite and magnetite; and glass beads. For using the carrier in the magnetic brush process, the magnetic materials are preferable. The volume average particle diameter of the core material of the carrier is generally in the range of from 10 μm to 500 μm, preferably from 30 μm to 100 μm.

As the method for coating with resin on the surface of the core material of the carrier, a coating method which includes coating a coating layer-forming solution containing the coating resin and additives if necessary being dissolved in an appropriate solvent is exemplified. Solvent may be selected in accordance with the coating resin to be used, the coating applicability and the like, without any limitation.

Specifically, the coating method with resin includes a dipping method that dips the core material of the carrier in the coating layer-forming solution, a spray method that sprays the coating layer-forming solution on the surface of the core material of the carrier, a fluidized bed method that mists the coating layer-forming solution on the core material of the carrier while the core material of the carrier is in a flowing state by using flowing air; and a kneader coater method that mixes the core material of the carrier with the coating layer-forming solution in a kneader coater, and removes the solvent therefrom.

The mixing ratio (ratio in part by weight) of the toner of the exemplary embodiment and the carrier in the two-component developer is preferably in the range of toner:carrier=about 1:100 to 30:100, more preferably about 3:100 to 20:100.

<Toner Cartridge, Process Cartridge and Image Forming Apparatus>

The image forming apparatus of the exemplary embodiment includes a latent image-holding member, a developing unit for developing an electrostatic latent image formed on the latent image-holding member to a toner image with an electrostatic latent image developer of the exemplary embodiment, a transfer unit for transferring the toner image formed on the latent image-holding member onto a receiving material, and a fixing unit for fixing the toner image transferred on the receiving material, and may include other unit such as cleaning unit for cleaning the residual components on the latent image-holding member, if necessary.

The image forming apparatus of the exemplary embodiment may satisfactorily be for example a color image-forming apparatus repeating sequentially primary transfer of the toner image held on the latent image-holding member such as photoreceptor drum onto an intermediate transfer medium, or a tandem type color image forming apparatus where plural latent image-holding members equipped with a developing vessel for each color are arranged in series on an intermediate transfer medium.

In the image forming apparatus, a part including the developing unit may be in a cartridge structure (process cartridge) attachable to and detachable from the body of the image forming apparatus. As the process cartridge, the process cartridge which is equipped with at least a developer-holding member and the electrostatic image developer of the exemplary embodiment is placed therein is preferably used.

Hereinafter, the image forming apparatus of the exemplary embodiment will be explained with reference to the drawing.

FIG. 1 is a schematic constitutive view showing one example of the image forming apparatus of the exemplary embodiment. The image forming apparatus of the exemplary embodiment is of a tandem type structure, where plural photoreceptors as latent image-holding member, namely image forming unit are arranged.

As shown in FIG. 1, in the image forming apparatus of the exemplary embodiment, four image forming units 50Y, 50M, 50C and 50K each of them forms color image of yellow, magenta, cyan and black, respectively, and an image forming unit 50T that forms a transparent image are arranged in parallel (tandem configuration) at intervals.

Each of the image forming units 50Y, 50M, 50C, 50K and 50T is in the same constitution except for the toner color in the developer placed therein, the image forming unit 50Y that forms yellow image is herein described representatively. Further, the parts corresponding to the other image forming units are marked in the same manner as in the image forming unit 50Y with the reference symbol with magenta (M), cyan (C), black (K) and transparency (T), respectively instead of yellow (Y) so as to skip the descriptions about each of the image forming units 50M, 50C, 50K and 50T. In the exemplary embodiment, the toner of the exemplary embodiment is used as the toner (transparent toner) in the developer placed in the imaging unit 50T.

The image forming unit 50Y of yellow is equipped with a photoreceptor 11Y as a latent image-holding member. The photoreceptor 11Y is rotated and driven at a predetermined process speed along the arrow direction A shown in the figure with a driving unit, which is not shown in the figure. As the photoreceptor 11Y, for example, an organic photoreceptor at sensitivity in the infrared region is used.

The charging roll (charging unit) 18Y is arranged at the upper part of the photoreceptor 11Y, and a predetermined voltage is applied by an electric source which is not shown in the figure, to the charging roll 18Y, so as to charge the surface of the photoreceptor 11Y to a predetermined potential.

At the periphery of the photoreceptor 11Y, an exposing device (electrostatic latent image-forming unit) 19Y for forming an electrostatic latent image by exposing the surface of the photoreceptor 11Y to light is arranged at the downstream side of the charging roll 18Y along the rotation direction of the photoreceptor 11Y. In view of space, an LED array which may be miniaturized is used herein as the exposing device 19Y. However, the exposing device 19Y is not limited to the LED array. Other electrostatic latent image-forming units using a laser beam or the like may, of course, be used without problem.

At the periphery of the photoreceptor 11Y, a developing device (developing unit) 20Y equipped with a developer-holding member for holding a yellow developer is arranged at the downstream side of the exposing device 19Y along the rotation direction of the photoreceptor 11Y, so as to make the electrostatic latent image formed on the surface of the photoreceptor 11Y visually observable with the yellow toner to form the toner image on the surface of the photoreceptor 11Y.

An intermediate transfer belt (primary transfer unit) 33 for primarily transferring the toner image formed on the surface of the photoreceptor 11Y is arranged at the lower part of the photoreceptor 11Y, which spreads over the lower parts of the five photoreceptors 11T, 11Y, 11M, 11C and 11K. The intermediate transfer belt 33 is pressed against the surface of the photoreceptor 11Y with a primary transfer roll 17Y. In addition, the intermediate transfer belt 33 is stretched and laid with three rolls of driving roll 12, support roll 13 and bias roll 14, so that the intermediate transfer belt 33 can rotate along the direction with the arrow B at a transfer speed equal to the process speed of the photoreceptor 11Y. On the surface of the intermediate transfer belt 33, a transparent toner image is primarily transferred prior to the yellow toner image being primarily transferred. Then, the yellow toner image is primarily transferred thereon, followed by sequential primary transfer thereon of toner images of individual colors of magenta, cyan and black for lamination.

At the periphery of the photoreceptor 11Y, a cleaning device 15Y for cleaning residual toner or transferred toner on the surface of the photoreceptor 11Y is arranged at the downstream side of the primary transfer roll 17Y along the rotation direction (arrow direction A) of the photoreceptor 11Y. The cleaning blade of the cleaning device 15Y is arranged in press contact with the surface of the photoreceptor 11Y along the counter direction of the rotation direction.

A secondary transfer roll (secondary transfer unit) 34 is arranged in press contact via the intermediate transfer belt 33 with the bias roll 14 around which the intermediate transfer belt 33 is trained. The toner images that have been primarily transferred and laminated onto the surface of the intermediate transfer belt 33 are electrostatically transferred to the surface of a recording paper P (a receiving material), which is fed from a paper cassette which is not shown in the figure, at the region where the bias roll 14 and the secondary transfer roll 34 are press-contacted with each other. In this case, in the toner images which have been transferred and laminated onto the intermediate transfer belt 33, the transparent toner image is at the lowest position (a position where it is in contact with the intermediate transfer belt 33), and therefore, in the toner images which have been transferred to the surface of the recording paper P, the transparent toner image is at the highest position.

A fixing device 35 (fixing unit) for fixing the toner image multiply transferred onto the surface of the recording paper P with heat and pressure to make a permanent image is arranged at the downstream side of the secondary transfer roll 34.

The fixing device for use in the exemplary embodiment includes for example a fixing belt prepared by using a lower surface energy material such as fluorine resin component and silicone-based resins on the surface, and by forming belt shape, and a fixing roll prepared by using a lower surface energy material such as fluorine resin component and silicone-based resins on the surface, and by forming cylindrical shape.

Then, the operation of the image forming units 50T, 50Y, 50M, 50C and 50K for forming colored image of transparency, yellow, magenta, cyan and black, respectively, are now described. The operation of each of the image forming units 50T, 50Y, 50M, 50C and 50K is identical, so the operation of the yellow image forming unit 50Y is typically described.

In the yellow image forming unit 50Y, the photoreceptor 11Y rotates at a predetermined process speed along the direction A marked with the arrow. The surface of the photoreceptor 11Y is negatively charged to a predetermined potential with the charging roll 18Y. Subsequently, the surface of the photoreceptor 11Y is exposed with an exposing device 19Y, to form an electrostatic latent image in accordance with the image information. Continuously, the toner which has been negatively charged with the developing unit 20Y is developed reversely, while the electrostatic latent image formed on the surface of the photoreceptor 11Y is prepared as a visually observable image on the surface of the photoreceptor 11Y, so that a toner image is formed. Subsequently, the toner image on the surface of the photoreceptor 11Y is primarily transferred on the surface of the intermediate transfer belt 33 by the primary transfer roll 17Y. After primary transfer, residual components after transfer such as toner remained on the surface of the photoreceptor 11Y are scratched off and cleaned with a cleaning blade of the cleaning device 15Y, for preparing for the following image forming step.

The aforementioned operations are performed in each of the image forming units 50T, 50Y, 50M, 50C and 50K, so that toner images prepared as visually observable images on the surfaces of the photoreceptors 11T, 11Y, 11M, 11C and 11K are sequentially transferred plurally onto the surface of the intermediate transfer belt 33. In color modes, each of the toner images of transparency, yellow, magenta, cyan and black in this order are transferred plurally. In addition, in bicolor modes or tricolor modes, transfer is performed in the same order, with only toner images of needed colors being transferred singly or plurally. Subsequently, the toner image(s) transferred singly or plurally onto the surface of the intermediate transfer belt 33 are secondarily transferred by the secondary transfer roll 34 onto the surface of a recording paper P conveyed from the paper cassette which is not shown in the figure. Next, the toner image(s) are fixed by being subjected to heating and pressing at the fixing device 35. The toner remaining on the surface of the intermediate transfer belt 33 after the secondary transfer is cleaned with a belt cleaner 16 composed of a cleaning blade for the intermediate transfer belt 33.

In FIG. 1, the yellow image forming unit 50Y is in a constitution as a process cartridge attachable to and detachable from the body of the image forming apparatus, where the image forming unit 50Y is integrally arranged with the developing device 20Y containing a developer-holding member for holding the electrostatic latent image developer of yellow color, the photoreceptor 11Y, the charging roll 18Y and the cleaning device 15Y. In addition, each of the image forming units 50T, 50K, 50C and 50M is in a constitution as a process cartridge structure as well as the image forming unit 50Y.

Hereinafter, the toner cartridge of the exemplary embodiment will be explained. The toner cartridge of the exemplary embodiment is attachable to and detachable from an image forming apparatus and accommodates a toner to be fed to a developing unit arranged in the image forming apparatus. Herein, although the toner cartridge of the exemplary embodiment has only to contain at least a toner, depending on the mechanism of the image forming apparatus, for example, a developer may be further accommodated in the toner cartridge.

In the image forming apparatus with a constitution of the toner cartridge arranged in a attachable and detachable manner, the toner cartridge placing therein the toner of the exemplary embodiment can be applicable so as to readily feed the toner of the exemplary embodiment to the developing device.

The image forming apparatus shown in FIG. 1 is an image forming apparatus with a constitution where the toner cartridges 40Y, 40M, 40C, 40K and 40T are attachable and detachable, while the developing devices 20Y, 20M, 20C, 20K and 20T are in connection with a toner cartridge corresponding to each developing device (color) with a toner supply tube which is not shown in the figure. In addition, when the toner placed in a toner cartridge draws to an end, the toner cartridge can be exchanged.

<Image Forming Method>

The image forming method of the exemplary embodiment includes a latent image-forming step for forming an electrostatic latent image on a latent image-holding member, an image forming step of developing the electrostatic latent image formed on the latent image-holding member using the electrostatic latent image developer of the exemplary embodiment which is held in the developer-holding member to form a toner image, a transfer step of transferring the toner image formed on the latent image-holding member onto a receiving material, and a fixing step of fixing the toner image transferred on the receiving material, where the shape factor SF1 of the domain of the release agent on the cross section of the fixed toner image is from 100 or about 100 to 140 or about 140.

When the shape factor SF1 of the domain of the release agent on the cross section of the transparent toner image formed with the toner of the exemplary embodiment is from 100 or about 100 to 140 or about 140, the domain of the release agent is spherical so that the scattered reflection of incident light to the fixed image is suppressed to prevent the occurrence of gloss unevenness after fixing.

The shape factor SF1 of the domain of the release agent is preferably from 100 or about 100 to 135 or about 135, more preferably from 100 or about 100 to 130 or about 130.

The shape factor SF1 of the domain of the release agent on the cross section of the toner image is a value obtained as follows.

The toner image is cut into a 5-mm square piece, which is then embedded in a liquid epoxy resin of a bisphenol A type with a curing agent to prepare a cutting sample. The sample is cut into pieces at −100° C. to a thickness of 100 nm to prepare observation samples using a cutter with a diamond knife, for example LEICA ultra-microtome (trade name, manufactured by Hitachi Technologies). At this time, the cutting sample is cut along the direction vertical to the toner image so as to observe the toner image, whereby the cross section of the toner image can be readily observed. Then the cross section of the toner is observed using a scanning electron microscope (SEM). The microscopic images thus obtained are taken through a video camera into a Luzex image processor to determine the maximum length and projected area of the domain of the release agents in total of 100, for calculation of the average value according to the aforementioned formula (1), to obtain the shape factor SF1.

The crystal growth of the release agent at the fixing step can be suppressed in the toner of the exemplary embodiment, so that the crystal shape of the release agent hardly falls flat, so the crystal is readily retained at a spherical shape. Consequently, the shape factor SF1 is in the range of from 100 or about 100 to 140 or about 140.

EXAMPLES

The exemplary embodiment of the invention is described in more detail with reference to the following Examples. However, the exemplary embodiment is not limited to the following Examples. Further, the term "part" means "part by weight", unless otherwise specified.

(Preparation of Dispersion (1) of Release Agent)

Paraffin wax (FNP0090, trade name, manufactured by Nippon Seiro Co., Ltd. melting temperature of 90° C.): 100 parts Anionic surfactant (Neogen RK, trade name, manufactured by Dai-ichi Kogyo Seiyaku Co., Ltd.): 1.0 part Poly(aluminium chloride) (PAC) (manufactured by Oji Paper Co., Ltd.; 30% powdery product): 1.2 parts Ion exchange water: 400 parts The aforementioned materials are mixed together and are then heated to 95° C., for dispersion using a homogenizer (Ultratalux T50, trade name, manufactured by IKA Co., Ltd.). Subsequently, the dispersion is treated for dispersion for 360 minutes with a Manton-Gauline high pressure homogenizer (Gauline Co., Ltd.) to prepare a dispersion (1) of the release agent (at a solid concentration of 20%), which is thus produced by dispersing the release agent of the volume average particle diameter of 0.24 μm.

(Preparation of Dispersion (2) of Release Agent)

Paraffin wax (FNP0090, trade name, manufactured by Nippon Seiro Co., Ltd.; the melting temperature of 90° C.): 100 parts Anionic surfactant (Neogen RK, trade name, manufactured by Dai-ichi Kogyo Seiyaku Co., Ltd.): 1.0 part PAC (manufactured by Oji Paper Co., Ltd.; 30% powdery product): 0.6 part Ion exchange water: 400 parts The aforementioned materials are mixed together and are then heated to 95° C., for dispersion using a homogenizer (Ultratalux T50, trade name, manufactured by IKA Co., Ltd.). Subsequently, the dispersion is treated for dispersion for 360 minutes with a Manton-Gauline high pressure homogenizer (Gauline Co., Ltd.) to prepare a dispersion (2) of the release agent (at a solid concentration of 20%), which is thus produced by dispersing the wax of the volume average particle diameter of 0.23 μm.

(Preparation of Dispersion (3) of Release Agent)

Paraffin wax (FNP0090, trade name, manufactured by Nippon Seiro Co., Ltd.; the melting temperature of 90° C.): 100 parts Anionic surfactant (Neogen RK, trade name, manufactured by Dai-ichi Kogyo Seiyaku Co., Ltd.): 1.0 part PAC (manufactured by Oji Paper Co., Ltd.; 30% powdery product): 0.3 part Ion exchange water: 400 parts The aforementioned materials are mixed together and dispersed together in the same manner as for the dispersion (1) of the release agent, to prepare a dispersion (3) of the release agent (at a solid concentration of 20%).

(Preparation of Dispersion (4) of Release Agent)

Paraffin wax (FNP0090, trade name, manufactured by Nippon Seiro Co., Ltd.; the melting temperature of 90° C.): 100 parts Anionic surfactant (Neogen RK, trade name, manufactured by Dai-ichi Kogyo Seiyaku Co., Ltd.): 1.0 part PAC (manufactured by Oji Paper Co., Ltd.; 30% powdery product): 0.1 part Ion exchange water: 400 parts The aforementioned materials are mixed together and dispersed together in the same manner as for the dispersion (1) of the release agent, to prepare a dispersion (4) of the release agent (at a solid concentration of 20%).

(Preparation of Dispersion (5) of Release Agent)

Paraffin wax (FNP0090, trade name, manufactured by Nippon Seiro Co., Ltd.; the melting temperature of 90° C.): 100 parts Anionic surfactant (Neogen RK, trade name, manufactured by Dai-ichi Kogyo Seiyaku Co., Ltd.): 1.0 part Ion exchange water: 400 parts The aforementioned materials are mixed together and dispersed together in the same manner as for the dispersion (1) of the release agent, to prepare a dispersion (5) of the release agent (at a solid concentration of 20%).

(Preparation of Dispersion (6) of Release Agent)

Paraffin wax (HNP9, trade name, manufactured by Nippon Seiro Co., Ltd.; melting temperature of 75° C.): 100 parts Anionic surfactant (Neogen RK, trade name, manufactured by Dai-ichi Kogyo Seiyaku Co., Ltd.): 1.0 part PAC (manufactured by Oji Paper Co., Ltd.; 30% powdery product): 0.6 part Ion exchange water: 400 parts The aforementioned materials are mixed together and dispersed together in the same manner as for the dispersion (1) of the release agent, to prepare a dispersion (6) of the release agent (at a solid concentration of 20%).

(Preparation of Dispersion (7) of Release Agent)

Paraffin wax (FNP0090, trade name, manufactured by Nippon Seiro Co., Ltd.; the melting temperature of 90° C.): 100 parts Anionic surfactant (Neogen RK, trade name, manufactured by Dai-ichi Kogyo Seiyaku. Co., Ltd.): 1.0 part Aluminium sulfate (SulA1) (manufactured by Asada Chemical Co., Ltd.; 17% powdery product): 1.0 part Ion exchange water: 400 parts The aforementioned materials are mixed together and dispersed together in the same manner as for the dispersion (1) of the release agent, to prepare a dispersion (7) of the release agent (at a solid concentration of 20%).

(Preparation of Dispersion (8) of Release Agent)

Ester wax (Nissan Electrol WEP5, trade name, manufactured by NOF Corporation; the melting temperature of 82° C.): 100 parts Anionic surfactant (Neogen RK, trade name, manufactured by Dai-ichi Kogyo Seiyaku Co., Ltd.): 1.0 part PAC (manufactured by Oji Paper Co., Ltd.; 30% powdery product): 0.6 part Ion exchange water: 400 parts The aforementioned materials are mixed together and dispersed together in the same manner as for the dispersion (1) of the release agent, to prepare a dispersion (8) of the release agent (at a solid concentration of 20%).

(Preparation of Dispersion (9) of Release Agent)

Polyethylene wax (PW600, trade name, manufactured by Toyo-Petrolite Co., Ltd.; the melting temperature of 92° C.): 100 parts Anionic surfactant (Neogen RK, trade name, manufactured by Dai-ichi Kogyo Seiyaku Co., Ltd.): 1.0 part PAC (manufactured by Oji Paper Co., Ltd.; 30% powdery product): 0.6 part Ion exchange water: 400 parts The aforementioned materials are mixed together and dispersed together in the same manner as for the dispersion (1) of the release agent, to prepare a dispersion (9) of the release agent (at a solid concentration of 20%).

(Preparation of Dispersion (10) of Release Agent)

Carnauba wax (RC-160, trade name, manufactured by To a Kasei Co., Ltd.; the melting temperature of 84° C.): 100 parts Anionic surfactant (Neogen RK, trade name, manufactured by Dai-ichi Kogyo Seiyaku Co., Ltd.): 1.0 part PAC (manufactured by Oji Paper Co., Ltd.; 30% powdery product): 0.6 part Ion exchange water: 400 parts The aforementioned materials are mixed together and dispersed together in the same manner as for the dispersion (1) of the release agent, to prepare a dispersion (10) of the release agent (at a solid concentration of 20%).

(Preparation of Dispersion (11) of Release Agent)

Paraffin wax (Paraffin Wax 150, trade name, manufactured by Nippon Seiro Co., Ltd.; the melting temperature of 66° C.): 100 parts Anionic surfactant (Neogen RK, trade name, manufactured by Dai-ichi Kogyo Seiyaku Co., Ltd.): 1.0 part PAC (manufactured by Oji Paper Co., Ltd.; 30% powdery product): 0.6 part Ion exchange water: 400 parts The aforementioned materials are mixed together and dispersed together in the same manner as for the dispersion (1) of the release agent, to prepare a dispersion (11) of the release agent (at a solid concentration of 20%).

(Preparation of Dispersion (12) of Release Agent)

Paraffin wax (FT115, trade name, manufactured by Nippon Seiro Co., Ltd.; the melting temperature of 113° C.): 100 parts Anionic surfactant (Neogen RK, trade name, manufactured by Dai-ichi Kogyo Seiyaku Co., Ltd.): 1.0 part PAC (manufactured by Oji Paper Co., Ltd.; 30% powdery product): 0.6 part Ion exchange water: 400 parts The aforementioned materials are mixed together and dispersed together in the same manner as for the dispersion (1) of the release agent, to prepare a dispersion (12) of the release agent (at a solid concentration of 20%).

(Preparation of Dispersion (13) of Release Agent)

Paraffin wax (FT115, trade name, manufactured by Nippon Seiro Co., Ltd.; the melting temperature of 113° C.): 100 parts Anionic surfactant (Neogen RK, trade name, manufactured by Dai-ichi Kogyo Seiyaku Co., Ltd.): 1.0 part PAC (manufactured by Oji Paper Co., Ltd.; 30% powdery product): 0.1 part Ion exchange water: 400 parts The aforementioned materials are mixed together and dispersed together in the same manner as for the dispersion (1) of the release agent, to prepare a dispersion (13) of the release agent (at a solid concentration of 20%).

(Method for Measurement of the Content of the Metal Element Contained in the Release Agent)

The release agent portion in the cross-section of the toner is observed using an energy dispersive X-ray analyzer (trade name: 2300F, manufactured by JEOL Ltd.) under the conditions of accelerating voltage being 30 kV, emission current being 20 μA, and 10000 magnifications. The ratio (%) of the metal element in the total elements to be measured is measured, whereby the Al content in the release agent can be obtained.

[Synthetic Preparation of Polyester Resin]

—Preparation of Polyester Resin (1)—

Dimethyl adipate: 74 parts

Dimethyl terephthalate: 192 parts

Addition product of bisphenol A with ethylene oxide: 216 parts

Ethylene glycol: 38 parts

Tetrabutyltitanate (catalyst): 0.037 part

The components are placed in a two-necked flask, into which nitrogen gas is introduced to retain the inside in inactive atmosphere; under agitation, the temperature is raised, for subsequent co-condensation and polymerization at 160° C. for 7 hours; while the pressure is thereafter reduced gradually to 10 Torr, the temperature is raised to and kept at 220° C. for 4 hours. Once the pressure is back to atmospheric pressure, 9 parts of trimellitic anhydride are added; then, the pressure is gradually reduced to 10 Torr, again, and is kept at the pressure for one hour, to synthetically prepare the polyester resin (1).

The glass transition temperature of the resulting polyester resin (1) is measured with a differential scanning calorimeter (DSC) by the method described above. The glass transition temperature is 65° C. The molecular weight of the resulting polyester resin (1) is measured by GPC according to the method described above. The weight average molecular weight (Mw) is 12,000 while the number average molecular weight is 4,000.

—Preparation of Polyester Resin (2)—

Addition product of bisphenol A with 2 moles of ethylene oxide: 114 parts

Addition product of bisphenol A with 2 moles of propylene oxide: 84 parts

Dimethyl terephthalate: 75 parts

Dodecenylsuccinic acid: 19.5 parts

Trimellitic acid: 7.5 parts

The components are placed in a 5-liter flask equipped with an agitator, a nitrogen inlet tube, a temperature sensor and a distillation tower, and the temperature is raised to 190° C. over one hour; the reaction system is agitated, in which 3.0 parts of dibutyltin oxide are subsequently added. While generated water is distilled off, the temperature is raised from 190° C. to 240° C. over 6 hours; at 240° C., dehydration and condensation reaction is continued for another 2 hours, to synthetically prepare the polyester resin (2).

The glass transition temperature of the resulting polyester resin (2) is 57° C.; the polyester resin is at an acid value of 15.0 mg KOH/g, with the weight average molecular weight of 58,000 and the number average molecular weight of 5,600.

[Preparation of Polyester Resin Dispersion]

—Preparation of Polyester Resin Dispersion (1)—

Polyester resin (1) (Mw: 12,000): 160 parts by weight

Ethyl acetate: 233 parts

Aqueous sodium hydroxide solution (0.3N): 0.1 part

The components are placed in a 1000-ml separable flask, for heating at 70° C., and the mixture is agitated with a three-one motor (manufactured by Shinto Scientific Co., Ltd.) to prepare a resin mixture solution. Under further agitation of the resin mixture solution, 373 parts of ion exchange water are added gradually to the resin mixture solution, so as to cause phase-inversion emulsification followed by removing the solvent, to obtain a polyester resin dispersion (1) (at a solid concentration of 30%). The volume average particle diameter of the resin particle in the dispersion is 160 nm.

—Preparation of Polyester Resin Dispersion (2)—

In the same manner for the polyester resin dispersion (1) except for the use of the polyester resin (2) in place of the polyester resin (1), a polyester resin dispersion (2) (at a solid concentration of 30%) is prepared. The volume average particle diameter of the resin particle in the dispersion is 160 nm.

Example 1

Toner Preparation

Ion exchange water: 450 parts

Polyester resin dispersion (1): 210 parts

Polyester resin dispersion (2): 210 parts

Anionic surfactant: 2.8 parts (Neogen RK, trade name, manufactured by Dai-ichi Kogyo Seiyaku Co., Ltd., 20% by weight)

The components are placed in a 3-liter reaction container equipped with a thermometer, a pH meter, and an agitator; while controlling the temperature with a mantle heater from the outside, the reaction mixture is retained at a temperature of 30° C. and an agitation rotation number of 150 rpm for 30 minutes. Subsequently, 100 parts of the dispersion (1) of the release agent are added, and the mixture is retained for 5 minutes, to which aqueous 0.3N nitric acid solution is added to adjust the pH at the aggregation step to 3.0.

While dispersing the reaction mixture with a homogenizer (Ultratalux T50, trade name, manufactured by IKA Japan Co., Ltd.), an aqueous PAC solution prepared by dissolving 1.0 part of PAC (manufactured by Oji Paper Co., Ltd., 30% powdery product) in 10 parts of ion exchange water is added. Under agitation, then, the temperature is raised to 50° C.; the particle size is measured with a Coulter Multi-sizer (aperture, diameter: 50 μm; manufactured by Coulter), and the volume average particle diameter is 5.0 μm. Subsequently, 110 parts of the polyester resin dispersion (1), and 73 parts of the polyester resin dispersion (2) are further added, to adhere the resin particles on the surface of the aggregated particle (shell structure).

Continuously, 40 parts of aqueous 10% by weight NTA (nitrilotriacetic acid) metal salt solution (Chelest 70, trade name, manufactured by Chelest Corporation) are added, and the resulting mixture is adjusted to pH 9.0, using aqueous 1N sodium hydroxide solution. Subsequently, the temperature is raised to 90° C. at a temperature increase speed of 0.05° C./min; and the mixture is retained at 90° C. for 3 hours. Thereafter, the mixture is cooled and filtered to obtain crude toner particles. The crude toner particles are again dispersed in ion exchange water and then filtered. The washing procedures of redispersing and filtering are repeatedly carried out until when the electrical conductivity of the filtrate reaches to 20 μS/cm or less. After that, the crude toner particles are vacuum dried in an oven at 40° C. for 5 hours to obtain the toner particles.

The resulting toner particle of 100 parts by weight is mixed and blended with 1.5 parts by weight of hydrophobic silica (RY50, trade name, manufactured by Nippon Aerosil) and 1.0 part by weight of hydrophobic titanium oxide (T805, trade name, manufactured by Nippon Aerosil) at 10,000 rpm for 30 seconds, using a sample mill. Subsequently, the resulting toner particles are sieved with a vibration sieve of an aperture size of 45 pan, to prepare a toner (1). The volume average particle diameter of the resulting toner (1) is 6.1 μm.

<Carrier Preparation>

Toluene: 14 parts

Styrene-methyl methacrylate copolymer (component ratio: 80:20; weight average molecular weight: 70,000): 2 parts MZ500 (zinc oxide; Titanium Industry Co., Ltd.): 0.6 part The components are mixed together and agitated with a stirrer for 10 minutes, to prepare a solution for forming a coating layer, where zinc oxide is dispersed. Then, the coating solution and 100 parts of ferrite particles (volume average particle diameter: 38 μm) are placed in a kneader of vacuum deaeration type, for agitation at 60° C. for 30 minutes; the mixture is further heated and deaerated under reduced pressure, and dried to prepare a carrier.

<Preparation of Electrostatic Latent Image Developer>

The resulting carrier and the toner (1) are mixed together at a ratio of 100 parts:8 parts in a 2-liter V blender to prepare an electrostatic latent image developer (1).

<Evaluation>

Figure 2:
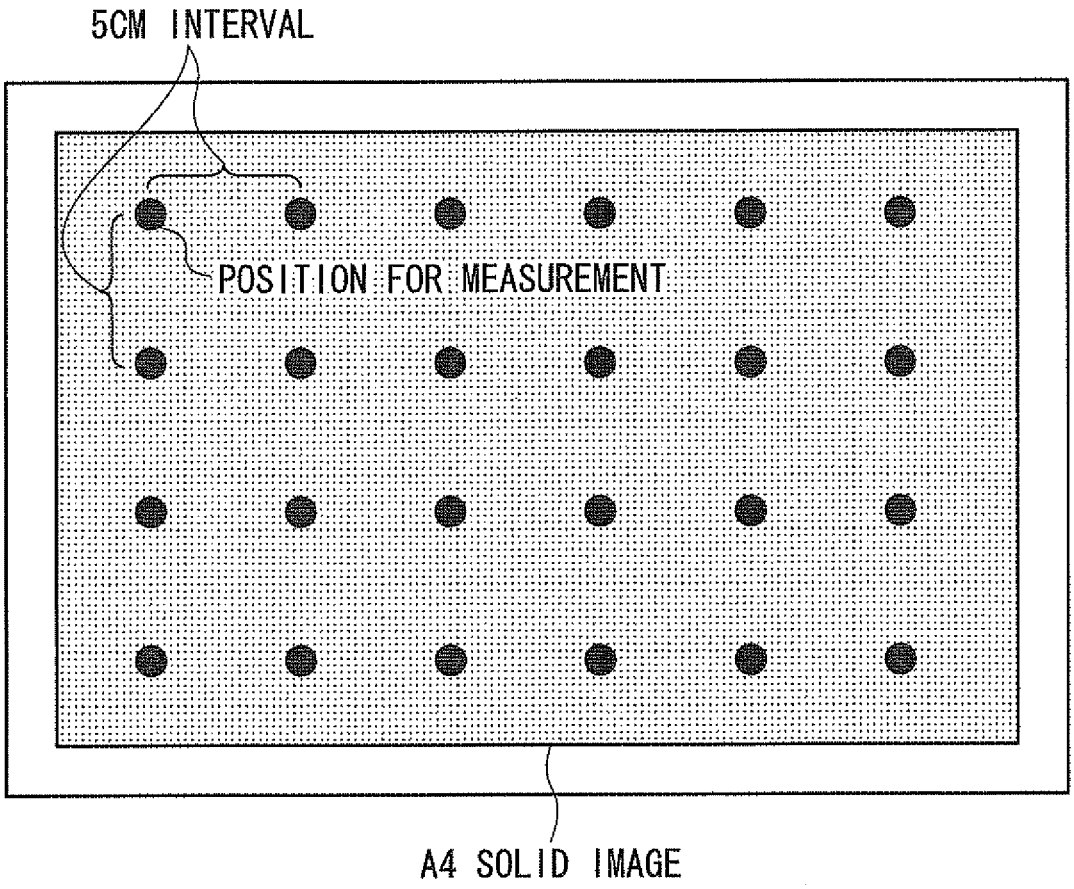
FIG. 2 is a view showing the position where the gloss level is measured in one Example.

The resulting developer is filled in the developing vessel of DocuCentre-III C7600-modified machine (5-tandem modified machine for double face printing) of a 5-tandem type as manufactured by Fuji Xerox Co., Ltd. shown in FIG. 1. A solid image (18 cm×27 cm) is formed on both sides of a A4 recording paper (OK topcoat+paper, manufactured by Oji Paper Co., Ltd.) at a fixing temperature of 190° C. Using a gloss meter (BYK micro-trigloss meter (20+60+85°; manufactured by Gardner Corporation), 60° gloss of the image part of the solid image formed on the precedent face is measured at 24 points thereon (points at a longitudinal/crosswise interval of 5 cm which are formed in lattice-like alignment) as shown in FIG. 2. Based on the difference (the maximum value−the minimum value) of the gloss levels at the 24 points, gloss unevenness is evaluated. The evaluation criteria are as follows. The results are shown in Table 1.

Evaluation Criteria of Gloss Unevenness

A: gloss level difference is less than 5% and the standard deviation of the gloss levels measured at the 24 points is 2.5 or less.

B: gloss level difference is less than 5%.

C: gloss level difference is 5% or more to less than 10%.

D: gloss level difference is more than 10%.

Tm and Tc of the toner (1) are measured with a differential scanning calorimeter (DSC) according to the method described above. The difference between Tm and Tc is 25° C. The gloss unevenness is evaluated for the electrostatic latent image developer (1) to give the following results. The precedent face of the solid image is at the maximum gloss value of 68 and with a gloss level difference of 3, and the standard deviation of the gloss levels at the 24 points is 1.9. The gloss unevenness is evaluated as A.

Table 1 shows the results for Examples and Comparative Examples, together with Al contents (atom %) in the domain of the release agent.

Comparative Example 1

In the same manner as in Example 1 except for the use of the dispersion (5) of the release agent in place of the dispersion (1) of the release agent, the toner (16) and the electrostatic latent image developer (16) are obtained. First, Tm and Tc of the toner (16) are measured with a differential scanning calorimeter (DSC). The difference between Tm and Tc is 5° C. Using the electrostatic latent image developer (16), gloss unevenness is evaluated. The precedent face of the solid image is at the maximum gloss value of 74 and with a gloss level difference of 24, and the standard deviation of the gloss levels at the 24 points is 5.4. The gloss unevenness is evaluated as D. Hence, the image quality is seriously problematic.

Comparative Example 2

In the same manner as in Example 1 except for the use of the dispersion (11) of the release agent in place of the dispersion (1) of the release agent, the toner (17) and the electrostatic latent image developer (17) are obtained. First, Tm and Tc of the toner (17) are measured with a differential scanning calorimeter (DSC). The difference between Tm and Tc is 3° C. Using the electrostatic latent image developer (17), gloss unevenness is evaluated. The precedent face of the solid image is at the maximum gloss value of 73 and with a gloss level difference of 18, and the standard deviation of the gloss levels at the 24 points is 4.4. The gloss unevenness is evaluated as D. Hence, the image quality is seriously problematic.

Example 2

In the same manner as in Example 1 except for the use of the dispersion (2) of the release agent in place of the dispersion (1) of the release agent, the toner (2) and the electrostatic latent image developer (2) are obtained. First, Tm and Tc of the toner (2) are measured with a differential scanning calorimeter (DSC). The difference between Tm and Tc is 24° C. Using the electrostatic latent image developer (2), gloss unevenness is evaluated. The precedent face of the solid image is at the maximum gloss value of 72 and with a gloss level difference of 3, and the standard deviation of the gloss levels at the 24 points is 2.0. The gloss unevenness is evaluated as A.

Example 3

In the same manner as in Example 1 except for the use of the dispersion (3) of the release agent in place of the dispersion (1) of the release agent, the toner (3) and the electrostatic latent image developer (3) are obtained. First, Tm and Tc of the toner (3) are measured with a differential scanning calorimeter (DSC). The difference between Tm and Tc is 17° C. Using the electrostatic latent image developer (3), gloss unevenness is evaluated. The precedent face of the solid image is at the maximum gloss value of 74 and with a gloss level difference of 4, and the standard deviation of the gloss levels at the 24 points is 1.9. The gloss unevenness is evaluated as A.

Example 4

In the same manner as in Example 1 except for the use of the dispersion (4) of the release agent in place of the dispersion (1) of the release agent, the toner (4) and the electrostatic latent image developer (4) are obtained. First, Tm and Tc of the toner (4) are measured with a differential scanning calorimeter (DSC). The difference between Tm and Tc is 13° C. Using the electrostatic latent image developer (4), gloss unevenness is evaluated. The precedent face of the solid image is at the maximum gloss value of 73 and with a gloss level difference of 4, and the standard deviation of the gloss levels at the 24 points is 2.1. The gloss unevenness is evaluated as A.

Example 9

In the same manner as in Example 2 except for the modification of 16 parts of 10% by weight NTA added in place of 40 parts of 10% by weight NTA added, the toner (5) and the electrostatic latent image developer (5) are obtained. First, Tm and Tc of the toner (5) are measured with a differential scanning calorimeter (DSC). The difference between Tm and Tc is 24° C. Using the electrostatic latent image developer (5), gloss unevenness is evaluated. The precedent face of the solid image is at the maximum gloss value of 27 and with a gloss level difference of 3, and the standard deviation of the gloss levels at the 24 points is 1.2. The gloss unevenness is evaluated as A. However, the image gloss level is low. The peeling property is particularly poor, while the image is rough.

Example 6

In the same manner as in Example 2 except for the modification of 20 parts of 10% by weight NTA added in place of 40 parts of 10% by weight NTA added, the toner (6) and the electrostatic latent image developer (6) are obtained. First, Tm and Tc of the toner (6) are measured with a differential scanning calorimeter (DSC). The difference between Tm and Tc is 24° C. Using the electrostatic latent image developer (6), gloss unevenness is evaluated. The precedent face of the solid image is at the maximum gloss value of 48 and with a gloss level difference of 3, and the standard deviation of the gloss levels at the 24 points is 1.5. The gloss unevenness is evaluated as A.

Example 7

In the same manner as in Example 2 except for the modification of 60 parts of 10% by weight NTA added in place of 40 parts of 10% by weight NTA added, the toner (7) and the electrostatic latent image developer (7) are obtained. First, Tm and Tc of the toner (7) are measured with a differential scanning calorimeter (DSC). The difference between Tm and Tc is 24° C. Using the electrostatic latent image developer (7), gloss unevenness is evaluated. The precedent face of the solid image is at the maximum gloss value of 73 and with a gloss level difference of 4, and the standard deviation of the gloss levels at the 24 points is 1.8. The gloss unevenness is evaluated as A.

Example 8

In the same manner as in Example 2 except for the modification of 80 parts of 10% by weight NTA added in place of 40 parts of 10% by weight NTA added, the toner (8) and the electrostatic latent image developer (8) are obtained. First, Tm and Tc of the toner (8) are measured with a differential scanning calorimeter (DSC). The difference between Tm and Tc is 24° C. Using the electrostatic latent image developer (8), gloss unevenness is evaluated. The precedent face of the solid image is at the maximum gloss value of 78 and with a gloss level difference of 7, and the standard deviation of the gloss levels at the 24 points is 3.2. The gloss unevenness is evaluated as C. However, the gloss unevenness is at a level of not practically problematic.

Example 9

In the same manner as in Example 1 except for the use of the dispersion (6) of the release agent in place of the dispersion (1) of the release agent, the toner (9) and the electrostatic latent image developer (9) are obtained. First, Tm and Tc of the toner (9) are measured with a differential scanning calorimeter (DSC). The difference between Tm and Tc is 12° C. Using the electrostatic latent image developer (9), gloss unevenness is evaluated. The precedent face of the solid image is at the maximum gloss value of 73 and with a gloss level difference of 4, and the standard deviation of the gloss levels at the 24 points is 1.9. The gloss unevenness is evaluated as A.

Example 10

In the same manner as in Example 1 except for the use of the dispersion (7) of the release agent in place of the dispersion (1) of the release agent, the toner (10) and the electrostatic latent image developer (10) are obtained. First, Tm and Tc of the toner (10) are measured with a differential scanning calorimeter (DSC). The difference between Tm and Tc is 25° C. Using the electrostatic latent image developer (10), gloss unevenness is evaluated. The precedent face of the solid image is at the maximum gloss value of 74 and with a gloss level difference of 4, and the standard deviation of the gloss levels at the 24 points is 2.1. The gloss unevenness is evaluated as A.

Example 11

In the same manner as in Example 1 except for the use of the dispersion (8) of the release agent in place of the dispersion (1) of the release agent, the toner (11) and the electrostatic latent image developer (11) are obtained. First, Tm and Tc of the toner (11) are measured with a differential scanning calorimeter (DSC). The difference between Tm and Tc is 16° C. Using the electrostatic latent image developer (11), gloss unevenness is evaluated. The precedent face of the solid image is at the maximum gloss value of 73 and with a gloss level difference of 3, and the standard deviation of the gloss levels at the 24 points is 1.8. The gloss unevenness is evaluated as A.

Example 12

In the same manner as in Example 1 except for the use of the dispersion (9) of the release agent in place of the dispersion (1) of the release agent, the toner (12) and the electrostatic latent image developer (12) are obtained. First, Tm and Tc of the toner (12) are measured with a differential scanning calorimeter (DSC). The difference between Tm and Tc is 26° C. Using the electrostatic latent image developer (12), gloss unevenness is evaluated. The precedent face of the solid image is at the maximum gloss value of 75 and with a gloss level difference of 3, and the standard deviation of the gloss levels at the 24 points is 2.0. The gloss unevenness is evaluated as A.

Example 13

In the same manner as in Example 1 except for the use of the dispersion (10) of the release agent in place of the dispersion (1) of the release agent, the toner (13) and the electrostatic latent image developer (13) are obtained. First, Tm and Tc of the toner (13) are measured with a differential scanning calorimeter (DSC). The difference between Tm and Tc is 19° C. Using the electrostatic latent image developer (13), gloss unevenness is evaluated. The precedent face of the solid image is at the maximum gloss value of 71 and with a gloss level difference of 4, and the standard deviation of the gloss levels at the 24 points is 1.8. The gloss unevenness is evaluated as A.

Example 14

In the same manner as in Example 1 except for the use of the dispersion (12) of the release agent in place of the dispersion (1) of the release agent, the toner (14) and the electrostatic latent image developer (14) are obtained. First, Tm and Tc of the toner (14) are measured with a differential scanning calorimeter (DSC). The difference between Tm and Tc is 47° C. Using the electrostatic latent image developer (14), gloss unevenness is evaluated. The precedent face of the solid image is at the maximum gloss value of 74 and with a gloss level difference of 4, and the standard deviation of the gloss levels at the 24 points is 1.9. The gloss unevenness is evaluated as A.

Example 15

In the same manner as in Example 1 except for the use of the dispersion (13) of the release agent in place of the dispersion (1) of the release agent, the toner (15) and the electrostatic latent image developer (15) are obtained. First, Tm and Tc of the toner (15) are measured with a differential scanning calorimeter (DSC). The difference between Tm and Tc is 23° C. Using the electrostatic latent image developer (15), gloss unevenness is evaluated. The precedent face of the solid image is at the maximum gloss value of 75 and with a gloss level difference of 3, and the standard deviation of the gloss levels at the 24 points is 2.1. The gloss unevenness is evaluated as A.

TABLE 1

| Example | Release agent dispersion | Toner No. | Wax type | Release agent type | Melting temperature ° C. | Amount of coagulant in release agent dispersion (parts by weight) | Tm − Tc | NTA | Al content in atom % | Maximum gloss value | Gloss difference | Standard deviation | Gloss unevenness |
|---|---|---|---|---|---|---|---|---|---|---|---|---|---|
| 1 | 1 | 1 | Paraffin wax | FNP 0090 | 90 | PAC 1.2 | 25° C. | 2.0% | 0.021 | 68 | 3 | 1.9 | A |
| 2 | 2 | 2 | Paraffin wax | FNP 0090 | 90 | PAC 0.6 | 24° C. | 2.0% | 0.015 | 72 | 3 | 2.0 | A |
| 3 | 3 | 3 | Paraffin wax | FNP 0090 | 90 | PAC 0.3 | 17° C. | 2.0% | 0.013 | 74 | 4 | 1.9 | A |
| 4 | 4 | 4 | Paraffin wax | FNP 0090 | 90 | PAC 0.1 | 13° C. | 2.0% | 0.014 | 73 | 4 | 2.1 | A |

TABLE 1-continued

| Example | Release agent dispersion | Toner No. | Wax type | Release agent type | Melting temperature ° C. | Amount of coagulant in release agent dispersion (parts by weight) | Tm − Tc | NTA | Al content in atom % | Maximum gloss value | Gloss difference | Standard deviation | Gloss unevenness |
|---|---|---|---|---|---|---|---|---|---|---|---|---|---|
| 5 | 2 | 5 | Paraffin wax | FNP 0090 | 90 | PAC 0.6 | 24° C. | 0.8% | 0.13 | 27 | 3 | 1.2 | A |
| 6 | 2 | 6 | Paraffin wax | FNP 0090 | 90 | PAC 0.6 | 24° C. | 1.0% | 0.09 | 48 | 3 | 1.5 | A |
| 7 | 2 | 7 | Paraffin wax | FNP 0090 | 90 | PAC 0.6 | 24° C. | 3.0% | 0.007 | 73 | 4 | 1.8 | A |
| 8 | 2 | 8 | Paraffin wax | FNP 0090 | 90 | PAC 0.6 | 24° C. | 4.0% | 0.004 | 78 | 7 | 3.2 | C |
| 9 | 6 | 9 | Paraffin wax | HNP 9 | 75 | PAC 0.6 | 12° C. | 2.0% | 0.013 | 73 | 4 | 1.9 | A |
| 10 | 7 | 10 | Paraffin wax | FNP 0090 | 90 | $Al_2(SO_4)_2$ 1.0 | 25° C. | 2.0% | 0.017 | 74 | 4 | 2.1 | A |
| 11 | 8 | 11 | Ester wax | WEP5 | 82 | PAC 0.6 | 16° C. | 2.0% | 0.016 | 73 | 3 | 1.8 | A |
| 12 | 9 | 12 | Polyethylene wax | PW600 | 92 | PAC 0.6 | 26° C. | 2.0% | 0.013 | 75 | 3 | 2.0 | A |
| 13 | 10 | 13 | Carnauba wax | RC-160 | 84 | PAC 0.6 | 19° C. | 2.0% | 0.015 | 71 | 4 | 1.8 | A |
| 14 | 12 | 14 | Paraffin wax | FT115 | 113 | PAC 0.6 | 47° C. | 2.0% | 0.016 | 74 | 4 | 1.9 | A |
| 15 | 13 | 15 | Paraffin wax | FT115 | 113 | PAC 0.1 | 23° C. | 2.0% | 0.013 | 75 | 3 | 2.1 | A |
| Comparative Example 1 | 5 | 16 | Paraffin wax | FNP 0090 | 90 | — | 5° C. | 2.0% | 0 | 74 | 24 | 5.4 | D |
| Comparative Example 2 | 11 | 17 | Paraffin wax | Paraffin wax 150 | 66 | PAC 0.6 | 3° C. | 2.0% | 0.014 | 73 | 18 | 4.4 | D |

What is claimed is:

1. A transparent toner for developing an electrostatic latent image, comprising a binder resin; and a release agent having a domain, and Al being present inside the domain of the release agent, the difference between the endothermic peak Tm of the release agent in a temperature increasing process and the exothermic peak Tc of the release agent in a temperature decreasing process being from about 10° C. to about 50° C., where Tm and Tc are measured with a differential scanning calorimeter (DSC) according to the ASTM method, wherein:

the binder resin is a polyester resin having an acid value from about 3.0 mg KOH/g to about 30.0 mg KOH/g;

the release agent has a melting temperature ranging from 90° C. to 115° C.; and the transparent toner has a colorant content of about 0.01% by weight or less.

2. The transparent toner for developing an electrostatic latent image according to claim 1, wherein the melting temperature of the polyester resin is from about 50° C. to about 100° C.

3. The transparent toner for developing an electrostatic latent image according to claim 1, wherein the polyester resin comprises a diol component which is a linear-chain aliphatic diol having about 7 to about 20 carbon atoms in the main chain structure thereof.

4. The transparent toner for developing an electrostatic latent image according to claim 1, wherein the weight average molecular weight (Mw) of the polyester resin is from about 6,000 to about 35,000.

5. The transparent toner for developing an electrostatic latent image according to claim 1, wherein the content of Al in the domain of the release agent as measured by X ray fluorescence spectrometry is from about 0.005 atom % to about 0.1 atom %.

6. The transparent toner for developing an electrostatic latent image according to claim 1, wherein the content of the release agent in the toner is from about 0.5% by weight to about 15% by weight.

7. The transparent toner for developing an electrostatic latent image according to claim 1, wherein the volume average particle diameter of the toner is from about 4 μm to about 9 μm.

8. The transparent toner for developing an electrostatic latent image according to claim 1, wherein the shape factor SF1 of the toner is from about 110 to about 140.

9. An electrostatic latent image developer comprising the transparent toner for developing an electrostatic latent image according to claim 1 and a carrier.

10. The electrostatic latent image developer according to claim 9, wherein the carrier comprises a white conductive material.

11. A toner cartridge that is attachable to and detachable from an image forming apparatus and comprises the transparent toner for developing an electrostatic latent image according to claim 1 to be fed to a developing unit arranged in the image forming apparatus.

12. A process cartridge comprising at least a developer-holding member and comprising the electrostatic latent image developer according to claim 9.

13. An image forming apparatus comprising:

a latent image-holding member, a developing unit that develops an electrostatic latent image formed on the latent image-holding member as a toner image comprising the electrostatic latent image developer according to claim 9, a transfer unit that transfers the toner image formed on the latent image-holding member onto a receiving material, and a fixing unit that fixes the toner image transferred onto the receiving material.

14. An image forming method comprising forming an electrostatic latent image on a latent image-holding member, developing the electrostatic latent image formed on the latent image-holding member as a toner image using the electrostatic latent image developer according to claim 9 held on a developer-holding member, transferring the toner image formed on the latent image-holding member onto a receiving material, and fixing the toner image transferred onto the receiving material, where the shape factor SF1 of a domain of a release agent on a cross section of the fixed toner image is from about 100 to about 140.

* * * * *